US011000168B2

(12) United States Patent
Lee et al.

(10) Patent No.: US 11,000,168 B2
(45) Date of Patent: May 11, 2021

(54) VACUUM CLEANER AND CONTROLLING METHOD OF THE VACUUM CLEANER

(71) Applicant: Samsung Electronics Co., Ltd., Suwon-si (KR)

(72) Inventors: Seon-gu Lee, Yongin-si (KR); Seung-moo Lim, Suwon-si (KR); Bu-mun Jung, Hwaseong-si (KR); Gi-hyeong Lee, Suwon-si (KR); Jae-shik Jeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 330 days.

(21) Appl. No.: 16/045,025

(22) Filed: Jul. 25, 2018

(65) Prior Publication Data

US 2019/0045994 A1 Feb. 14, 2019

(30) Foreign Application Priority Data

Aug. 9, 2017 (KR) ..... 10-2017-0101195

(51) Int. Cl.
*A47L 9/28* (2006.01)
*H02J 7/00* (2006.01)
(Continued)

(52) U.S. Cl.
CPC ..... *A47L 9/2857* (2013.01); *A47L 5/24* (2013.01); *A47L 9/2842* (2013.01);
(Continued)

(58) Field of Classification Search
CPC ..... A47L 9/2857; A47L 9/2842; A47L 5/24; A47L 9/2884; A47L 9/322; A47L 9/28; H02J 7/0063
See application file for complete search history.

(56) References Cited

U.S. PATENT DOCUMENTS 5,495,636 A 3/1996 Dekker et al.
5,666,688 A 9/1997 Kim
(Continued)

FOREIGN PATENT DOCUMENTS

CN 102342804 A 2/2012
CN 102460943 A 5/2012
(Continued)

OTHER PUBLICATIONS

Extended European Search Report dated Apr. 22, 2020, issued in European Application No. 18843717.2.
(Continued)

*Primary Examiner* — David Redding
(74) *Attorney, Agent, or Firm* — Jefferson IP Law, LLP

(57) ABSTRACT

A vacuum cleaner is provided. The vacuum cleaner includes a motor configured to rotate at a speed of predetermined revolutions per minute (RPM) in a normal mode, a first switch configured to control a power on/off operation of the vacuum cleaner, a second switch configured to change an operation mode of the vacuum cleaner, a battery unit including a first processor configured to, based on the first switch being pressed, control a power of the vacuum cleaner to be turned on, and a second processor configured to, based on the power of the vacuum cleaner being turned on according to an operation of the first switch, control the vacuum cleaner to operate in the normal mode, and according to an operation of the second switch in the normal mode, control the vacuum cleaner to operate in a standby mode where power supplied to the motor is turned off.

19 Claims, 13 Drawing Sheets

(52) U.S. Cl.
CPC ..... *A47L 9/2884* (2013.01); *A47L 9/322* (2013.01); *H02J 7/0063* (2013.01)

(56) References Cited

U.S. PATENT DOCUMENTS

| | | | |
|---|---|---|---|
| 8,350,508 | B2 | 1/2013 | Celik |
| 10,791,901 | B2 | 10/2020 | Moon et al. |
| 2010/0253262 | A1 | 10/2010 | Celik |
| 2012/0111367 | A1 | 5/2012 | Liu et al. |
| 2013/0207615 | A1 | 8/2013 | Sunderland et al. |
| 2013/0293164 | A1 | 11/2013 | Sakakibara et al. |
| 2014/0013540 | A1 | 1/2014 | Erko et al. |
| 2018/0103816 | A1 | 4/2018 | Moon et al. |

FOREIGN PATENT DOCUMENTS

| | | | |
|---|---|---|---|
| CN | 103384130 | A | 11/2013 |
| CN | 104414586 | A | 3/2015 |
| CN | 105022301 | A | 11/2015 |
| CN | 105942925 | A | 9/2016 |
| CN | 106510552 | A | 3/2017 |
| CN | 206138050 | U | 5/2017 |
| DE | 10 2014 110 223 | A1 | 1/2016 |
| EP | 2 043 492 | B1 | 9/2011 |
| EP | 2 040 597 | B1 | 11/2011 |
| EP | 2 848 173 | A1 | 3/2015 |
| JP | 08-252201 | A | 10/1996 |
| JP | 2000-116575 | A | 4/2000 |
| JP | 4069179 | B2 | 4/2008 |
| JP | 2011-244974 | A | 12/2011 |
| KR | 10-1233157 | B1 | 2/2013 |
| KR | 10-2016-0138719 | A | 12/2016 |
| WO | 2017/040880 | A1 | 3/2017 |

OTHER PUBLICATIONS

Chinese Office Action dated Mar. 12, 2021, issued in Chinese Application No. 201880043714.7.

FIG. 3B

| NO | OPERATION SWITCH | OPERATION MODE CHANGE CONDITIONS & TIMING | OPERATION FUNCTION EMBODIMENT |
|---|---|---|---|
| ① | FIRST SWITCH | TIME AT WHICH SWITCH IS PRESSED | SUPPLY BATTERY POWER AND DRIVE NORMAL MODE MOTOR |
| ② | FIRST SWITCH | TIME AT WHICH SWITCH IS PRESSED | STOP MOTOR DRIVING AND BLOCK BATTERY POWER SUPPLY |
| ③ | SECOND SWITCH | TIME FOR WHICH PREDETERMINED TIME $t_1$ OR MORE IS MAINTAINED WITH SWITCH BEING PRESSED | DRIVING MOTOR IN TURBO MODE |
| ④ | SECOND SWITCH | TIME AT WHICH PRESSING OF SWITCH IS RELEASED (RISING TIME) | DRIVING MOTOR IN NORMAL MODE |
| ⑤ | SECOND SWITCH | TIME AT WHICH PRESSING OF SWITCH IS RELEASED (RISING TIME) | STOP DRIVING MOTOR |
| ⑥ | SECOND SWITCH | TIME AT WHICH SWITCH IS PRESSED (FALLING TIME) | DRIVING MOTOR IN NORMAL MODE |
| ⑦ | -(AUTOMATIC) | WHEN THERE IS NO OPERATION DURING PREDETERMINED SECOND TIME $t_2$ | BLOCK BATTERY POWER SUPPLY |

100, 100', 400

VACUUM CLEANER AND CONTROLLING METHOD OF THE VACUUM CLEANER

CROSS-REFERENCE TO RELATED APPLICATION(S)

This application is based on and claims priority under 35 U.S.C. § 119 of a Korean patent application number 10-2017-0101195, filed on Aug. 9, 2017, in the Korean Intellectual Property Office, the disclosure of which is incorporated herein by reference in its entirety.

BACKGROUND

1. Field

The disclosure relates to a vacuum cleaner and a controlling method for a vacuum cleaner. More particularly, the disclosure relates to a vacuum cleaner for controlling an operation mode by operating a switch and a controlling method thereof.

2. Description of Related Art

A vacuum cleaner is a cleaning device configured to allow foreign substances such as dust outside the vacuum cleaner to be suctioned into the vacuum cleaner by using a pressure difference between the inside and the outside of the vacuum cleaner.

Typically, a vacuum cleaner includes an on/off switch for turning the vacuum cleaner on or off, and a mode operation switch for selecting an operation mode of the vacuum cleaner. A user uses the vacuum cleaner by turning on the power of the vacuum cleaner through an on/off switch and selecting an operation mode through a mode operation switch. The user uses two types of buttons to change an operation mode or turn off a power of a vacuum cleaner while using the vacuum cleaner.

For example, a mode operation switch may be operated to change a mode of the vacuum cleaner from a turbo mode to a normal mode, and an on/off switch may be operated to turn off the power of the vacuum cleaner when the vacuum cleaner operates in a turbo mode or in a normal mode.

However, operating two types of switches could be inconvenient for a user. In particular, easy operation is required for a vacuum cleaner that is convenient and simple to operate for a user such as a handy type vacuum cleaner or a handy-stick type vacuum cleaner.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a vacuum cleaner capable of operating all operation modes of the vacuum cleaner with one switch during the use and a controlling method thereof.

Additional aspects will be set forth in part in the description which follows and, in part, will be apparent from the description, or may be learned by practice of the presented embodiments.

In accordance with an aspect of the disclosure, a vacuum cleaner is provided. The vacuum cleaner includes a motor configured to rotate at a predetermined number of revolutions per minute (RPM) in a normal mode, a first switch configured to control a power on/off operation of the vacuum cleaner, a second switch configured to change an operation mode of the vacuum cleaner, a battery unit including a first processor configured to, based on the first switch being pressed, control a power of the vacuum cleaner to be turned on, and a second processor configured to, based on the power of the vacuum cleaner being turned on according to an operation of the first switch, control the vacuum cleaner to operate in the normal mode, and according to an operation of the second switch in the normal mode, control the vacuum cleaner to operate in a standby mode where power supplied to the motor is turned off.

In accordance with another aspect of the disclosure, a method for controlling a vacuum cleaner is provided. The method includes a motor, a first switch for controlling a power on/off operation, and a second switch for changing an operation mode including operating in a normal mode where the motor is rotated at a predetermined number of RPM based on a power of the vacuum cleaner being turned on according to an operation of the first switch, and operating in a standby mode where power supplied to the motor is turned off according to an operation of the second switch in the normal mode.

According to the above-described various embodiments, a user operates all operation modes of a vacuum cleaner with one switch during the use. Accordingly, the user's convenience of operation of the vacuum cleaner is enhanced.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which:

FIGS. 3A, 3B, and 3C are views provided to explain mode change of a vacuum cleaner according to an embodiment of the disclosure;

Throughout the drawings, it should be noted that like reference numbers are used to depict the same or similar elements, features, and structures

DETAILED DESCRIPTION

Figure 1:
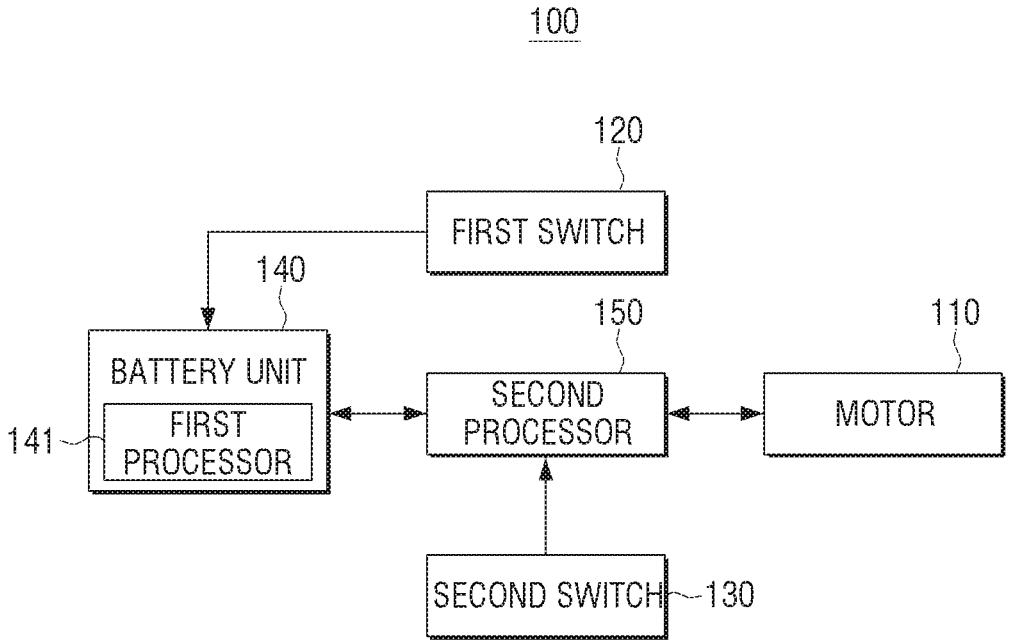
FIG. 1 is a block diagram provided to explain configuration of a vacuum cleaner according to an embodiment of the disclosure.

The following description with reference to the accompanying drawings is provided to assist in a comprehensive understanding of various embodiments of the disclosure as defined by the claims and their equivalents. It includes various specific details to assist in that understanding, but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but are merely used by the inventor to enable a clear and consistent understanding of the disclosure. Accordingly, it should be apparent to those skilled in the art that the following description of various embodiments of the disclosure is provided for illustration purposes only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In describing the disclosure, if it is determined that the detailed description of the related art will unnecessarily obscure the gist of the disclosure, a detailed description thereof will be omitted. Further, the suffix "part" for the constituent elements used in the following description is given or mixed in consideration of ease of specification, and does not have a meaning or role that distinguishes itself.

The terms used in the application are merely used to describe particular embodiments, and are not intended to limit the invention. Singular forms in the disclosure are intended to include the plural forms as well, unless the context clearly indicates otherwise.

It will be further understood that terms such as "including" or "having," etc., are intended to indicate the existence of the features, numbers, operations, actions, components, parts, or combinations thereof disclosed in the specification, and are not intended to preclude the possibility that one or more other features, numbers, operations, actions, components, parts, or combinations thereof may exist or may be added.

In an embodiment, "a module", "a unit", or "a part" perform at least one function or operation, and may be realized as hardware, such as a processor or integrated circuit, software that is executed by a processor, or a combination thereof. In addition, a plurality of "modules", a plurality of "units", or a plurality of 'parts' may be integrated into at least one module and may be realized as at least one processor except for "modules", "units" or "parts" that should be realized in a specific hardware.

When an element is referred to as being "connected" or "coupled" to another element, it can be directly connected or coupled to the other element or be indirectly connected or coupled to the another element with one or more intervening elements interposed therebetween. In addition, when an element is referred to as "including" a component, this indicates that the element may further include another component instead of excluding another component unless there is different disclosure.

FIG. 1 is a block diagram provided to explain configuration of a vacuum cleaner according to an embodiment of the disclosure.

Referring to FIG. 1, a vacuum cleaner 100 may include a motor 110, a first switch 120, a second switch 130, a battery unit 140 and a second processor 150.

It is desirable that the vacuum cleaner 100 is a handy type vacuum cleaner or a handy-stick type vacuum cleaner, but the disclosure is not limited thereto. The vacuum cleaner 100 according to embodiments of the disclosure could be any type such as a stand type vacuum cleaner, a cylindrical type vacuum cleaner, etc. as long as it is a vacuum cleaner.

The vacuum cleaner 100 may be a device that suctions and cleans foreign substances such as dust outside by using a pressure difference between the inside and the outside of the vacuum cleaner. The motor 110 may generate a pressure difference between the inside and the outside of the vacuum cleaner 100 according to the rotation. According to an embodiment of the disclosure, the motor 110 may rotate at a speed of different RPM according to an operation mode.

For example, the motor 110 may rotate at a speed of the first revolution per minute (RPM) when an operation mode of the vacuum cleaner 100 is a normal mode, and may rotate at a speed of the second RPM higher that the first RPM when an operation mode of the vacuum cleaner 100 is a turbo mode. As a rotational speed of the motor 110 increases, the pressure difference between the inside and the outside of the vacuum cleaner 100 increases, so that the vacuum cleaner 100 has a greater suction force in the turbo mode than in the normal mode.

The motor 110 may be a brushless DC (BLDC) motor, but the disclosure is not limited thereto. The motor 110 may also be a brush motor. Unlike a brush motor in which a brush is in contact with a commutator and power is supplied, the BLDC motor is suitable to be used as the motor 110 of the vacuum cleaner 100 since the BLDC motor has no brush, has a long life, has less frictional heat, is easy to be miniaturized due to the high efficiency, and has a fewer rotations due to the load.

The first switch 120 may be a switch for controlling a power on/off operation of the vacuum cleaner 100, and the second switch 130 may be a switch for changing an operation mode. A user may turn on or off a power of the vacuum cleaner 100 by operating the first switch 120, and change an operation mode of the vacuum cleaner 100 by operating the second switch 130.

According to an embodiment of the disclosure, the first switch 120 and the second switch 130 may be physically operated by a user, turned on when pressed by a user, and turned off when the pressing is released. The first switch 120 and the second switch 130 may be turned on since two ends of the switch are connected only while being pressed by the user.

The first switch 120 or the second switch 130 may be a tact switch, a micro switch or a limited switch, but the disclosure is not limited thereto. As long as a switch is turned on only while being pressed by the user, the switch may be used as the first switch 120 and the second switch 130 regardless of name. The first switch 120 may be a tact switch, and the second switch 130 may be a micro switch, but the disclosure is not limited thereto.

The battery unit 140 may supply power to the vacuum cleaner 100. The battery unit 140 may be detachable from the vacuum cleaner 100. FIG. 1 illustrates that the battery unit 140 is a configuration of the vacuum cleaner 110 when the battery unit 140 is attached to the vacuum cleaner 100. However, the disclosure is not limited thereto. According to an embodiment, the battery 140 may be integrated into the vacuum cleaner 100.

The battery unit 140 may include a first processor 141 for controlling the overall operation of the battery unit 140. For example, the first processor 141 may manage a power level of the battery unit 140, detect overcurrent and block power supplied to the vacuum cleaner 100.

When the first switch 120 is pressed, the first processor 141 may detect that the first switch 120 is pressed, and control the vacuum cleaner 100 so that a power of the vacuum cleaner 100 may be turned on or off. The first processor 141 may control the vacuum cleaner 100 to toggle a power on state and a power off state each time when the first switch 120 is pressed by a user.

The first processor 141 may control the vacuum cleaner 100 so that the vacuum cleaner 100 may be turned on when the first switch 120 is pressed while a power is turned off, and the vacuum cleaner 100 may be turned off when the first switch 120 is pressed while a power is turned on.

The first processor 141 may be one or more of a central processing unit (CPU), a micro-controller, an application processor (AP), or a communication processor (CP).

The second processor 150 may control the overall operation of the vacuum cleaner 100. The second processor 150 may control the vacuum cleaner 100 to operate in a normal mode when the power of the vacuum cleaner 100 is turned on according to the operation of the first switch 120.

When the first switch 120 is pressed while the power of the vacuum cleaner 100 is turned off, as described above, the power of the vacuum cleaner 100 may be turned on by the first processor 141. Accordingly, power may be supplied to each constituent element of the vacuum cleaner 100 including the second processor 150, and the second processor 150 may control the vacuum cleaner 100 to operate in a normal mode where the motor 110 is rotated at a speed of predetermined RPM.

The second processor 150 may control the vacuum cleaner 100 to operate in a standby mode according to the operation of the second switch 130 while the vacuum cleaner 100 operates in a normal mode. The standby mode may be a mode where power supplied to the motor 110 is turned off. Therefore, a mode of the vacuum cleaner 100 is changed to a standby mode from a normal mode, power supplied to the motor 110 may be blocked and the motor 110 may stop driving. In the standby mode, since the vacuum cleaner 100 is in a power-on state, power supplied to other configurations may be maintained.

The second processor 150 may control the vacuum cleaner 100 to operate in a turbo mode. As described above, the turbo mode may be a mode where the motor 110 rotates at a higher RPM than the RPM of the normal mode. In the turbo mode operation, the vacuum cleaner 100 may suction foreign substances such as dust with a greater suction force than in the normal mode operation. For example, the turbo mode may have a rotational speed twice than the normal mode, such as 30000 RPM for the normal mode and 60000 RPM for the turbo mode, but is not limited thereto.

According to an embodiment of the disclosure, the second processor 150 may control the vacuum cleaner 100 to operate in a standby mode or a in a turbo mode according to a time duration for which the second switch 130 is pressed while the vacuum cleaner 100 operates in a normal mode. The detailed description thereof will be made below.

The second processor 150 may be embodied as one or more of a CPU, a micro-controller, an AP, or a CP.

The terminology such as a normal mode, a standby mode, a turbo mode, etc. are merely examples of name for distinguish a state where the vacuum cleaner 100 operates, but the mode name of the vacuum cleaner 100 is not limited thereto. It should be understood that the normal mode, the standby mode and the turbo mode may be separately referred to as a first mode, a second mode and a third mode. In addition, a power-on state of the vacuum cleaner 100 may be referred to as on-mode, and a power-off state of the vacuum cleaner 100 may be referred to as off-mode.

It is described that the operation mode of the vacuum cleaner 100 may include a standby mode, a normal mode, and a turbo mode when a power is turned on. However, the operation mode of the vacuum cleaner 100 is not limited to the above three modes. According to an embodiment, an operation mode may be further added. According to an embodiment, when a power is turned on, the vacuum cleaner 100 may be embodied to operate in two modes such as a standby mode and a normal mode.

As described above, the vacuum cleaner 100 according to an embodiment of the disclosure, unlike the related art, when a power is turned on, may be changed to a normal mode, a turbo mode, and a standby mode only with one switch, that is, the second switch 130, and therefore, the user's convenience of operation of the vacuum cleaner can be increased.

Figure 2:
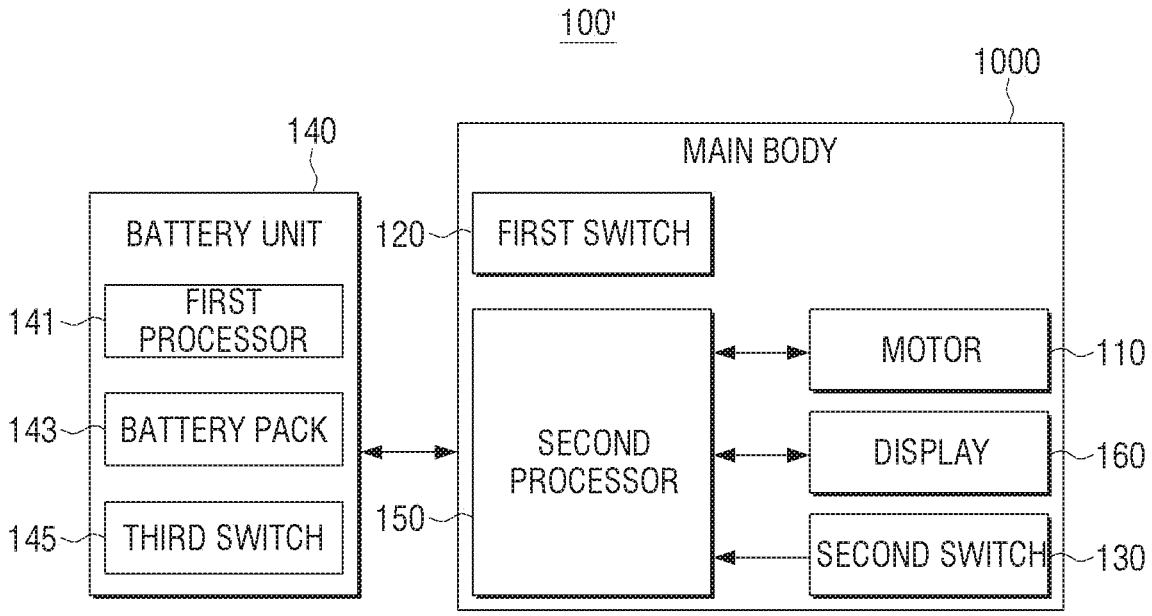
FIG. 2 is a block diagram provided to explain configuration of a vacuum cleaner according to an embodiment of the disclosure.

FIG. 2 is a block diagram provided to explain configuration of a vacuum cleaner according to an embodiment of the disclosure.

As described in FIG. 1, the battery unit 140 may be detachably attached to the vacuum cleaner 100. Therefore, the battery unit 140 may be detached from the vacuum cleaner 100, and in this case, the vacuum cleaner 100 may be defined by the battery unit 140 and the remainder. Referring to FIG. 2, the remaining constituent elements except for the battery unit 140 may be referred to as a main body 1000.

Referring to FIG. 2, a vacuum cleaner 100' may include a battery unit 140 and a main body 1000. The battery unit 140 may include a first processor 141, a battery pack 143 and a third switch 145.

The battery pack 143 may supply power to the main body 1000 of the vacuum cleaner 100' under the control of the first processor 141 when the battery unit 140 is engaged with the main body 1000. The battery pack 143 may be embodied as a rechargeable secondary battery. Therefore, although not shown, the battery unit 140 may include a charge interface connected to the battery pack 143. The battery pack 143 may be charged from an external power source such as AC power source through the charge interface. For example, the battery pack 143 may be a lead acid battery, a nickel cadmium battery, a nickel hydrogen battery, a lithium ion battery, a lithium polymer battery, or the like, but is not limited thereto.

The third switch 145 may connect the battery pack 143 to the main body 1000 or block the battery pack 143 from the main body 1000 under the control of the first processor 141 when the battery pack 140 is engaged with the main body 1000. Accordingly, power may be supplied or blocked from the battery pack 143 to the main body 1000.

The third switch 145 may be implemented by various semiconductor switches. For example, the third switch 145 may be implemented as a gate turn-off thyristor (GTO), a bipolar junction transistor (BJT), various field effect transistors (FETs), or insulated gate bipolar transistors, but is not limited thereto.

The first processor 141 may detect that the first switch 120 of the main body 1000 is turned on or off when the battery unit 140 is engaged with the main body 1000. The first processor 141 may turn on or off the third switch 145 depending on whether the first switch 120 is turned on or off, and control a power of the vacuum cleaner 100'.

When the first processor 141 detects that the first switch 120 is turned on while the power of the vacuum cleaner 100' is turned off, the processor 141 may control the power of the vacuum cleaner 100' to be turned on by turning on the third switch 145. The first processor 141 may detect that the first switch 120 is turned on while the power of the vacuum cleaner 100' is turned on and control the power of the vacuum cleaner 100' to be turned off by turning off the third switch 145.

The main body 1000 may be a remainder, except for the battery unit 140 of the vacuum cleaner 100'. The main body 1000 may include a motor 110, a first switch 120, a second switch 130, a second processor 150, and a display 160. The description on the motor 110, the first switch 120 and the second switch 150 is the same as described above. Therefore, the detailed description on the second processor 150 will be omitted to avoid redundancy.

The display 160 may display various images, text or graphics related to the operation of the vacuum cleaner 100'. The display 160 may be implemented in various forms, such as at least one of light emitting diode (LED) lamp, liquid crystal display (LCD), or organic LED (OLED). In addition, the display 160 may be configured as a touch screen together with a touch panel.

The second processor 150 may control the display 160 to display a user interface (UI) indicating a present operation mode of the vacuum cleaner 100'. According to an embodiment of the disclosure, the vacuum cleaner 100' may operate in three modes such as a standby mode, a normal mode, and a turbo mode when a power is turned on, and therefore the second processor 150 may display a UI indicating a standby mode, a normal mode, and a turbo mode according to an operation mode of the vacuum cleaner 100'.

Figure 6A:
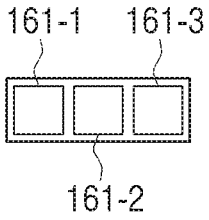
FIGS. 6A, 6B, and 6C are views illustrating a display provided in a vacuum cleaner according to an embodiment of the disclosure.
Figure 6B:
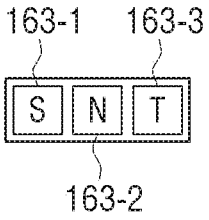
Figure 6C:
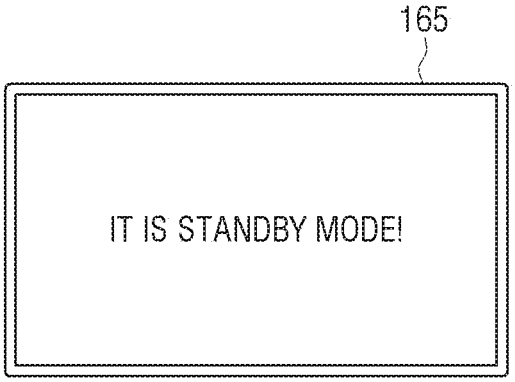

FIGS. 6A, 6B, and 6C are views illustrating a display provided in a vacuum cleaner according to an embodiment of the disclosure.

Referring to FIGS. 6A-6C, the UI indicating a present operation mode may vary depending on the embodiment form of a display. For example, as shown in FIG. 6A, when a display 160 is embodied with three LEDs 161-1, 161-2 and 161-3, the second processor 150 may control the display 160 so that one LED 161-1 may be turned on in a standby mode, and two LEDs 161-1 and 161-2 may be turned on in a normal mode, and three LEDs 161-1, 161-2 and 161-3 may be turned on in a turbo mode.

FIG. 6B illustrates an example where the display 160 is configured with three LEDs 163-1, 163-2 and 163-3, but unlike the display 160 shown in FIG. 6A, "S" indicating a standby mode may be printed on the LED 163-1, "N" indicating a normal mode may be printed on the LED 163-2, and "T" indicating a turbo mode may be printed on the LED 163-3. Therefore, the second processor 150 may control the display 160 so that the LED 163-1 may be turned on when the vacuum cleaner 100' operates in a standby mode, the LED 163-2 may be turned on when the vacuum cleaner 100' operates in a normal mode, and the LED 163-3 may be turned on when the vacuum cleaner 100' operates in a turbo mode, respectively. It should be understood that the text respectively printed on the LEDs 163-1, 163-2 and 163-3 are not limited to the example shown in FIG. 6B.

As shown in FIG. 6C, when the display 160 is embodied as an LCD display 165, the second processor 150 may control the display 160 to display a text "it is XX mode!" and display a present operation mode of the vacuum cleaner 100'. FIG. 6C illustrates that the vacuum cleaner 100' operates in a standby mode.

It should be understood that an example where the second processor 150 indicates a present operation mode of the vacuum cleaner 100' is not limited thereto, but an icon indicating each mode may be printed on LED and displayed on LCD.

When the power of the vacuum cleaner 100' is turned off according to the operation of the first switch 120, power supply to all configurations of the vacuum cleaner 100' including the display 160 and the second processor 150 may be blocked. Therefore, a UI cannot be displayed.

The second processor 150 may change an operation mode of the vacuum cleaner 100' by detecting the operation of the second switch 130 when the power of the vacuum cleaner 100' is turned on. The processor 150 may detect whether the second switch 130 is turned on or off, and a time duration for which the second switch 130 is turned on. The second processor 150 may detect a time when the second switch 130 is pressed, and a time when the pressing of the second switch 130 is released, and count a time during which the second switch 130 is pressed. Therefore, the second processor 150 may control the vacuum cleaner 100' to operate in a standby mode or in a turbo mode according to a time at which the second switch 130 is pressed in a normal mode.

According to an embodiment of the disclosure, the second processor 150 may control the vacuum cleaner 100' to operate in a turbo mode, when the second switch 130 is pressed for a predetermined time or more in a normal mode, from a time when the second switch 130 is pressed and a predetermined time passes until a time when the pressing of the second switch 130 is released.

The second processor 150 may count a time duration for which the pressing of the second switch 130 is maintained when the pressing of the second switch 130 is detected while the vacuum cleaner 100' operates in a normal mode. Accordingly, when the counted time duration passes a predetermined time, the second processor 150 may change a rotational speed of the motor 110 from a rotational speed in a normal mode to a rotational speed in a turbo mode, and display a UI indicating a present operation mode by changing from a normal mode UI to a turbo mode UI to display.

While the vacuum cleaner 100' operates in a turbo mode, when the pressing of the second switch 130 is released, the second processor 150 may control the vacuum cleaner 100' to operate in a normal mode. The second processor 150 may change a rotational speed of the motor 110 from a rotational speed in a turbo mode to a rotational speed in a normal mode, and display a UI indicating a present operation mode by changing from a turbo mode UI to a normal mode UI to display.

The second processor 150 may control the vacuum cleaner 100' to operate in a standby mode, while the vacuum cleaner 100' operates in a normal mode, when the second switch 130 is pressed, and the pressing of the second switch 130 is released within a predetermined time.

The second processor 150 may count a time duration for which the pressing is maintained when the pressing of the second switch 130 is detected while the vacuum cleaner 100' operates in a normal mode. Accordingly, when the pressing of the second switch 130 is released before a counted time passes a predetermined time, the second processor 150 may control the vacuum cleaner 100' to operate in a standby mode. The second processor 150 may block power supplied to the motor 110, and change a UI indicating a present operation mode by changing from a normal mode UI to a standby mode UI.

When the second switch 130 is pressed while the vacuum cleaner 100' operates in a standby mode, the processor 150 may control the vacuum cleaner 100' to operate in a normal mode. The second processor 150 may control the motor 110 to rotate at a rotational speed of a normal mode, and change a UI indicating a present operation mode by changing from a standby mode UI to a normal mode UI.

The predetermined time may be a time between 1 second and two seconds, and set by a manufacturer or a user of the vacuum cleaner 100', but the disclosure is not limited thereto.

According to an embodiment of the disclosure, the second processor 150 may control the vacuum cleaner 100' so that the power of the vacuum cleaner 100' may be turned off when a predetermined time passes without changing a mode when the vacuum cleaner 100' operates in a standby mode. The second processor 150 may count a time when the vacuum cleaner 100' enters a standby mode. When the counted time passes a predetermined time without changing a mode, the second processor 150 may transmit a control signal to turn off the power of the vacuum cleaner 100' to the first processor 141. The first processor 141 may turn off the third switch 145, and block power supplied to the main body 1000, thereby turning off the power of the vacuum cleaner 100'. The predetermined time may be, for example, 10 minutes, but the disclosure is not limited thereto.

According to an embodiment of the disclosure, the second processor 150 may identify a present operation mode of the vacuum cleaner 100' by storing information on the changed operation mode in a storage (not shown) or sensing current consumption when an operation mode is changed. The detailed description thereof is beyond the scope of the gist of the disclosure, and therefore, the detailed description will be omitted.

Figure 3A:
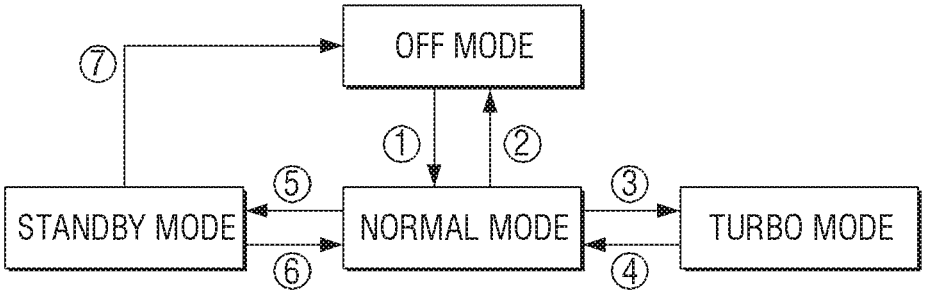
Figure 3C:
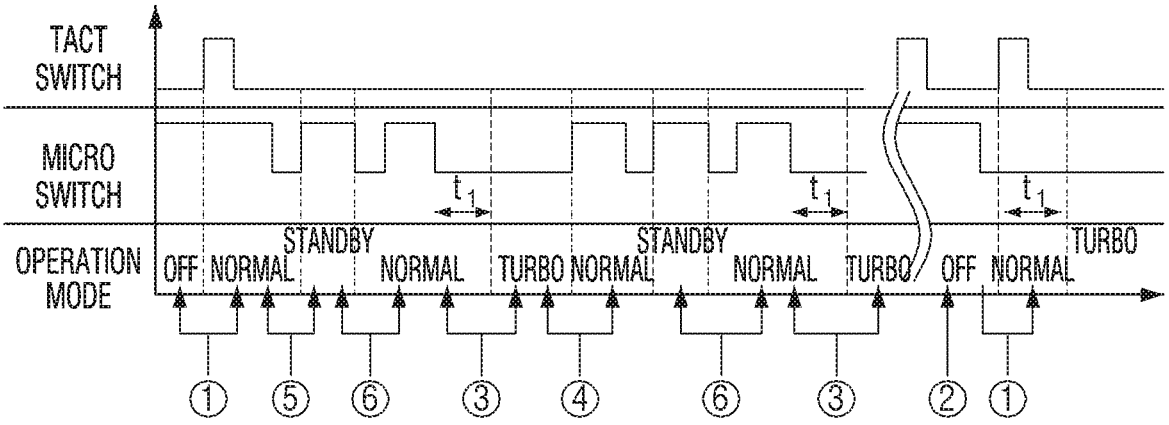

FIGS. 3A, 3B, and 3C are views provided to explain mode change of a vacuum cleaner according to an embodiment of the disclosure.

Referring to FIGS. 3A-3C, circles ① to ⑦ represent the same kind of operation mode.

① and ② indicate an on/off operation of a power of the vacuum cleaners 100 and 100' through the operation of the first switch 120. Referring to FIG. 3A, in a standby mode, a normal mode, and a turbo mode, the power of the vacuum cleaners 100 and 100' may be turned on, and in an off mode, the power of the vacuum cleaners 100 and 100' is turned off.

Referring to ① of FIGS. 3A, 3B, and 3C, when a user presses the first switch 120 in a state where the power of the vacuum cleaners 100 and 100' is turned off, the first processor 141 may detect the pressing of the first switch 120 and turn on the power of the vacuum cleaner 100' at a point of time when the first switch 120 is pressed. The first processor 141 may turn on the third switch 145 and turn on the power of the vacuum cleaner 100 and 100' as described above. When the power of the vacuum cleaner 100 and 100' is turned on, the vacuum cleaner 100 and 100' may operate in a normal mode.

Referring to ②, when a user presses the first switch 120 while the vacuum cleaner 100 and 100' operates in a normal mode, the first processor 141 may detect the pressing of the first switch 120, and turn off the power of the vacuum cleaner 100 and 100' at a time when the first switch 120 is pressed. The first processor 141 may turn off the third switch 145 to turn off the power of the vacuum cleaners 100 and 100' as described above.

Although not shown, even when the vacuum cleaner 100 and 100' is in standby mode, when a user presses the first switch 120, the first processor 141 may detect the pressing of the first switch 120 and turn off the power of the vacuum cleaner 100 and 100' at a time when the first switch 120 is pressed.

The user may turn on/off the power of the vacuum cleaner 100 and 100' by using the first switch 120.

Referring to ③ and ④, when a user presses the second switch 130 for t1 seconds or more, while the vacuum cleaners 100 and 100' operates in a normal mode, the vacuum cleaners 100 and 100' may operate in a turbo mode from a time at which the user presses the second switch 130 for t1 seconds or more, and when a user releases the second switch 130, the vacuum cleaner 100 and 100' may operate in a normal mode at a time when the user releases the second switch 130.

Referring to ⑤, when the user presses and releases the second switch 130 for a predetermined first time t1 or less while the vacuum cleaner 100 and 100' operates in a normal mode, the vacuum cleaner 100 and 100' may enter a standby mode by stopping a driving of the motor 110 at a time when the user releases the second switch 130.

Referring to ⑥, when the user presses the second switch 130 while the vacuum cleaner 100 and 100' operates in a standby mode, the vacuum cleaner 100 and 100' may operate in a normal mode at a time when the second switch 130 is pressed. When the second switch 130 is pressed in a standby mode, the vacuum cleaner 100 and 100' operates in a normal mode at a time when the second switch 130 is pressed in order to ensure consistency of operation of the vacuum cleaner 100 and 100' for a user by counting a time duration for which the second switch 130 is pressed, and based on the counted time duration being equal to or more than a predetermined first time t1, causing the vacuum cleaner 100 and 100' to operate in a turbo mode consistently. The predetermined first time t1 may be a time between 1 second and 2 seconds, but the disclosure is not limited thereto.

Referring to ⑦, when there is no operation during a predetermined second time t2 after the vacuum cleaner 100 and 100' enters a standby mode, the vacuum cleaner 100 and 100' may enter an off mode, and turn off the entire power of the vacuum cleaner 100 and 100'. This avoids unnecessary battery consumption since power is consumed even in a standby mode. Thus, when there is no operation during a predetermined second time t2 after entering a standby mode, it is considered that a user has no intension to use the vacuum cleaner 100 and 100'. The predetermined second time t2 may be 5 minutes, but the disclosure is not limited thereto.

Figure 4:
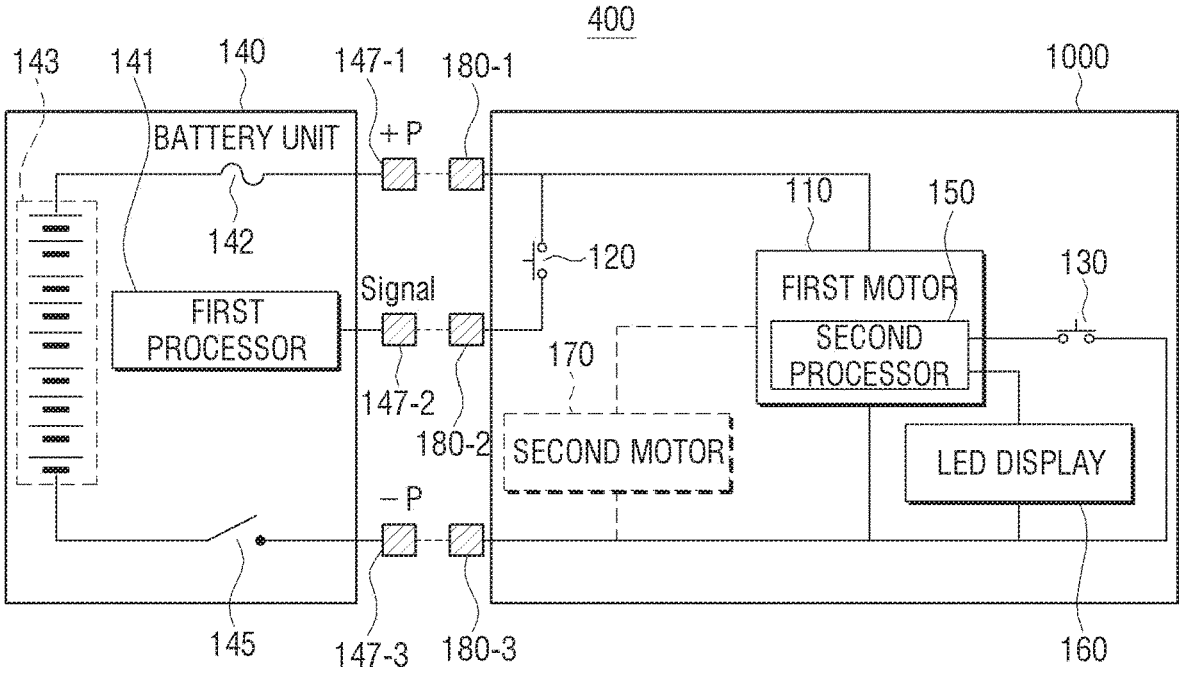
FIG. 4 is a detailed configuration view of another vacuum cleaner according to an embodiment of the disclosure.

FIG. 4 is a detailed configuration view of another vacuum cleaner according to an embodiment of the disclosure.

Referring to FIG. 4, a vacuum cleaner 400 may include a battery unit 140 and a main body 1000. The main body 1000 may include the first motor 110, the first switch 120, the second switch 130, the second processor 150, an LED display 160 and a second motor 170.

The battery unit 140 may include the first processor 141, the battery pack 143, a third switch 145, and an overcurrent protection unit 142. If an overcurrent flows beyond an allowable range, the overcurrent protection unit 142 may block current provided to the remaining elements of the battery pack 143 and prevent damage to the vacuum cleaner 400. The overcurrent protection unit 142 may be a fuse, but the disclosure is not limited thereto, and may be any type of battery protection circuit.

The first motor 110 may be the same configuration as the motor 110 described referring to FIGS. 1 and 2. FIG. 4 illustrates an example where the first motor 110 and the second processor 150 are embodied as one configuration or package. For example, the first motor 110 may be embodied as a BLDC motor, and the second processor 150 may be mounted on the BLDC motor. However, the disclosure is not limited thereto, but the first motor 110 and the BLDC motor may be embodied separately.

According to an embodiment, the vacuum cleaner 400 may include a second motor 170. For example, when the vacuum cleaner 400 is embodied as a handy type vacuum cleaner, a user may use a stick type vacuum cleaner by connecting a member such as an extension pipe 410 and a suction nozzle 420 to the vacuum cleaner 400 according to an example of usage. In this case, a roller may be mounted on a bottom surface of the suction nozzle 420 to easily suction dust. The second motor 170 may rotate a roller. The second motor 170 may be embodied as a brush motor, but the disclosure is not limited thereto. A rotational speed in a normal mode may be faster than a rotational speed in a turbo mode in the second motor.

As described above, FIG. 4 shows that the battery unit 140 of the vacuum cleaner 400 is detachably attached to the vacuum cleaner 400. According to FIG. 4, when the battery unit 140 is attached to the vacuum cleaner 400, three terminals 147-1 to 147-3 of the battery unit 140 may be respectively contacted to the other constituent elements of the vacuum cleaner 400 (three terminals 180-1 to 180-3 that are connected to the main body 1000). (+) terminal 147-1 of the battery unit 140 may be connected to (+) terminal 180-1 of the main body 1000, (−) terminal 147-3 of the battery unit 140 may be connected to (−) terminal 180-3 of the main body 1000, and a signal terminal 147-2 of the battery unit 140 may be connected to a signal terminal 180-2 of the main body 1000, respectively. Accordingly, the first processor 110 may detect an on/off state of the first switch 120, and control the third switch 145, thereby providing or blocking power supplied from the battery pack 143 to the main body 1000 of the vacuum cleaner 400.

The battery unit 140 may be separately charged through an AC charger (not shown) while being separated from the main body 1000, or charged in connection with the main body 1000.

Figure 5A:
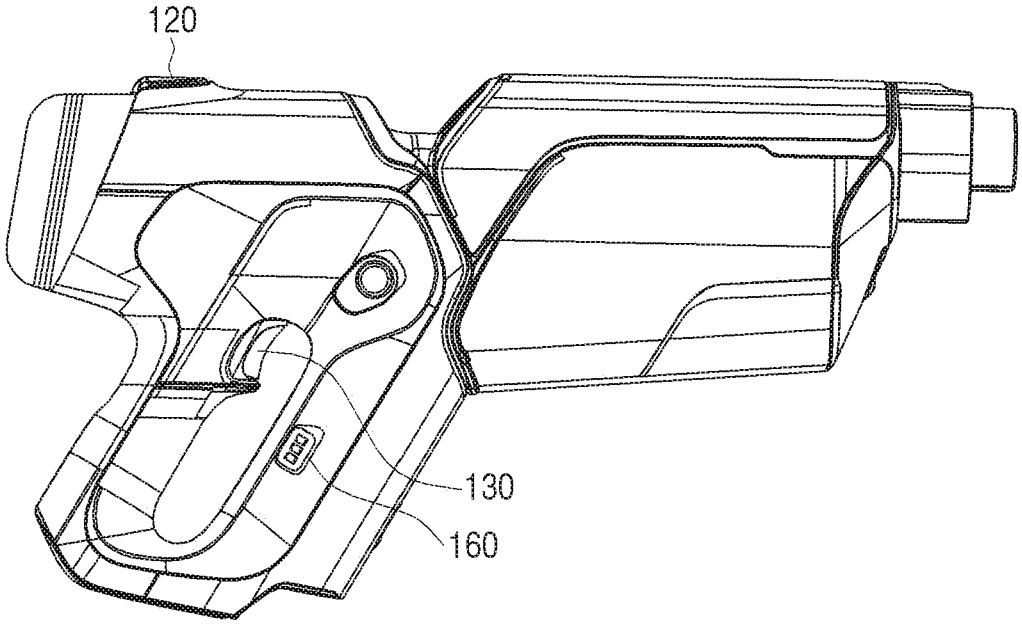
FIGS. 5A and 5B are views illustrating external appearances of a handy type vacuum cleaner according to an embodiment of the disclosure.
Figure 5B:
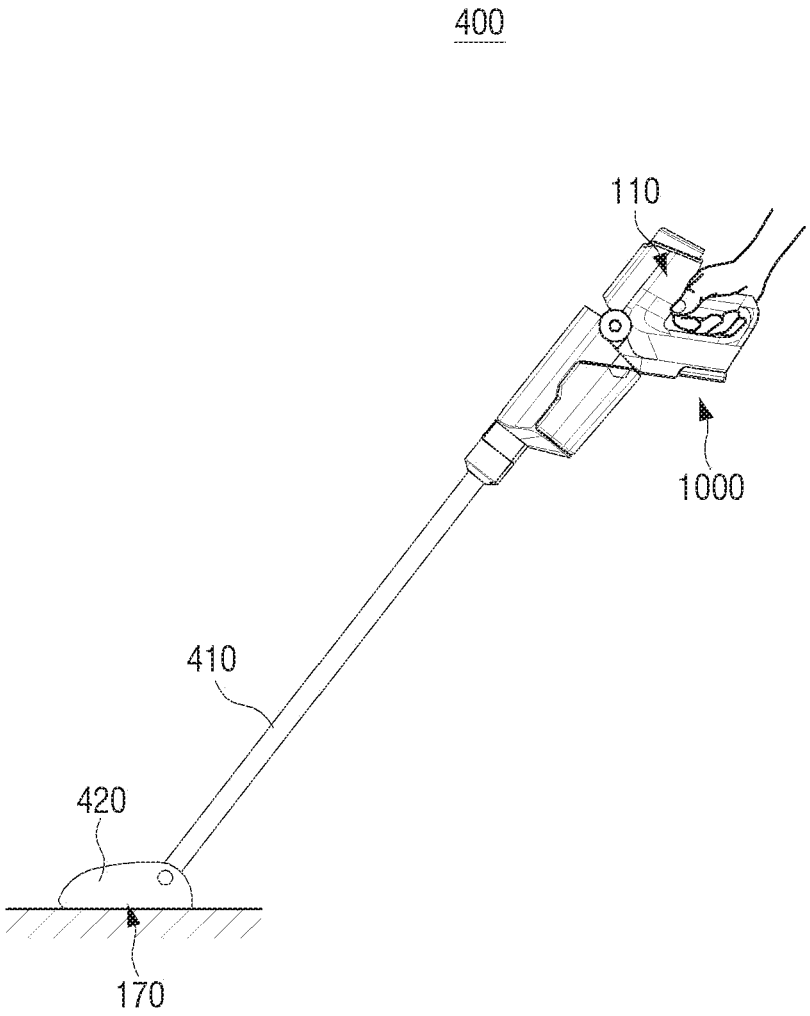

FIGS. 5A and 5B are views illustrating external appearances of a handy type vacuum cleaner according to an embodiment of the disclosure.

Referring to FIG. 5A, the vacuum cleaner 100, 100', and 400 may include a first switch 120 at an upper portion of a handle, and include a second switch 130 provide at a portion where a finger is touched when a user holds the handle. An LED display 150 may be provided on a side surface of a vacuum cleaner. Accordingly, a user may easily recognize the change of an on/off operation and an operation mode of a vacuum cleaner, as well as a present operation mode with a naked eye. The vacuum cleaner is easy to operate since an operation mode can be easily changed with only one hand during cleaning.

Referring to FIG. 5B, the extension pipe 410 and the suction nozzle 420 are connected to the vacuum cleaner 400 according to an embodiment. The first motor 110 that generates a pressure difference between the inside/outside of the vacuum cleaner 400 may be included in the main body 1000, and the second motor 170 for rotating a roller (not shown) included in the suction nozzle 420 may be included in the suction nozzle 420.

Figure 7:
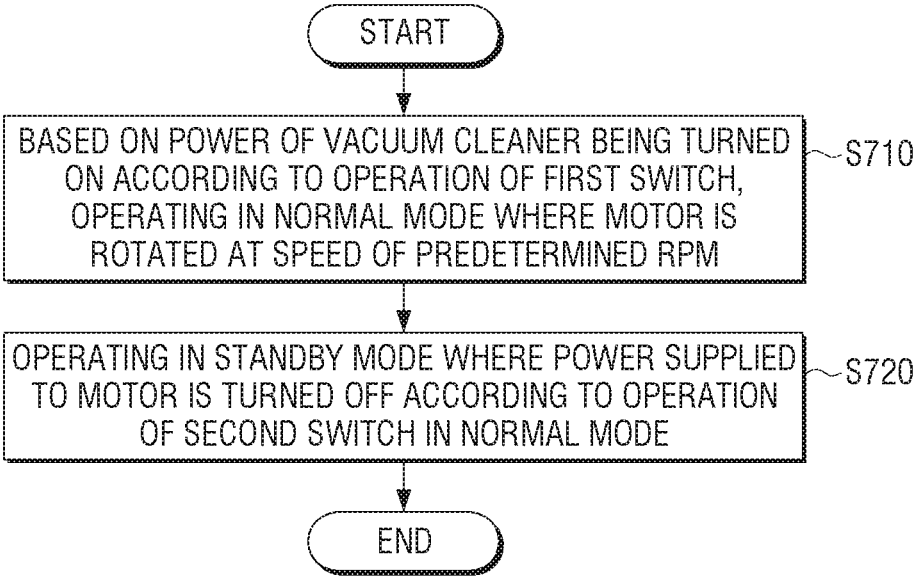
FIG. 7 is a flowchart provided to explain a method for controlling a vacuum cleaner according to an embodiment of the disclosure.

FIG. 7 is a flowchart provided to explain a method for controlling a vacuum cleaner according to an embodiment of the disclosure. The redundant description will be omitted in the description of FIG. 7.

Referring to FIG. 7, when the power of the vacuum cleaner 100, 100' and 400 is turned on according to the operation of the first switch 120, the vacuum cleaner 100, 100' and 400 may operate in a normal mode where the motor 110 is rotated at a speed of RPM at operation 710.

The vacuum cleaner 100, 100', and 400 may toggle between a power-on state and a power-off state each time when the first switch 120 is pressed, and when the vacuum cleaner 100, 100' and 400 is in a power-on state with the first switch 120 being pressed, the vacuum cleaner 100, 100' and 400 may operate in a normal mode.

A mode of the vacuum cleaner 100, 100' and 400 may be changed to a standby mode where power supplied to the motor 110 is turned off from a normal mode according to the operation of the second switch 130 at operation S720.

According to an embodiment of the disclosure, the vacuum cleaner 100, 100', and 400 may operate in a standby mode or in a turbo mode where the motor 110 is rotated at a speed of RPM higher than a predetermined RPM according to a time duration for which the second switch 130 is pressed in a normal mode.

When the second switch 130 is pressed for a predetermined time or more in a normal mode, the vacuum cleaner 100, 100', and 400 may operate in a turbo mode from a time at which the second switch 130 is pressed and a predetermined time passes until a time at which the pressing of the second switch 130 is released, and when the pressing of the second switch 130 is released during the operation in a turbo mode, the vacuum cleaner 100, 100', and 400 may operate in a normal mode.

When the second switch 130 is pressed and the pressing of the second switch 130 is released within a predetermined time in a normal mode, the vacuum cleaner 100, 100', and 400 may operate in a standby mode, and when the second switch 130 is pressed in a standby mode, the vacuum cleaner 100, 100', and 400 may operate in a normal mode. When a predetermined time passes without change from a standby mode to another mode, the vacuum cleaner 100, 100', and 400 may turn off the power of the vacuum cleaner 100, 100', and 400.

The vacuum cleaner 100, 100', and 400 may display a UI indicating a present operation mode of the vacuum cleaner 100, 100' and 400.

When the power of the vacuum cleaner 100, 100' and 400 is turned on according to the operation of the first switch 120, the vacuum cleaner 100, 100' and 400 may operate in a normal mode, when the second switch 130 is pressed for a predetermine time or more in a normal mode, the vacuum cleaner 100, 100' and 400 may operate in a turbo mode, and when the second switch 130 is pressed for a predetermine time or less in a normal mode, the vacuum cleaner 100, 100' and 400 may operate in a standby mode. However, the disclosure is not limited to the embodiment.

Figure 9:
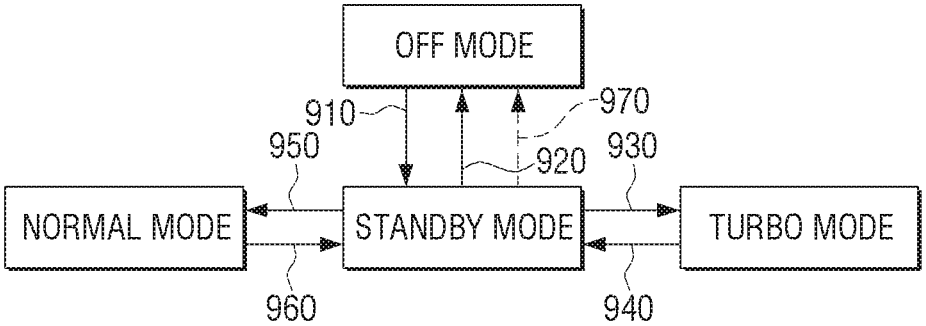
Figure 10:
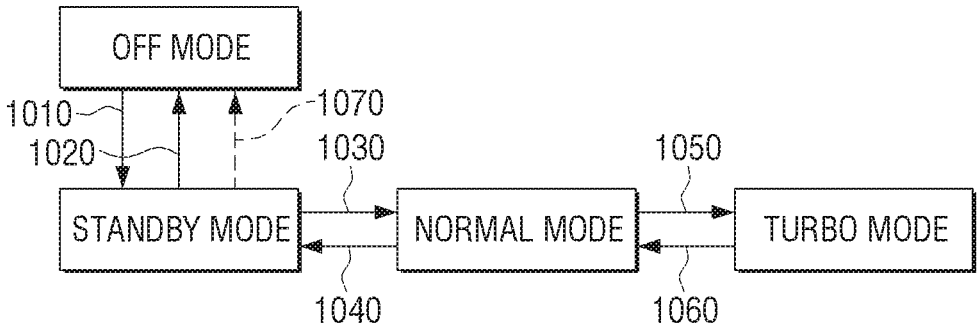

Hereinafter, another embodiment of the disclosure will be described with reference to FIGS. 8 to 10. For convenience of explanation, FIGS. 8 to 10 are shown in a form similar to FIG. 3A.

Figure 8:
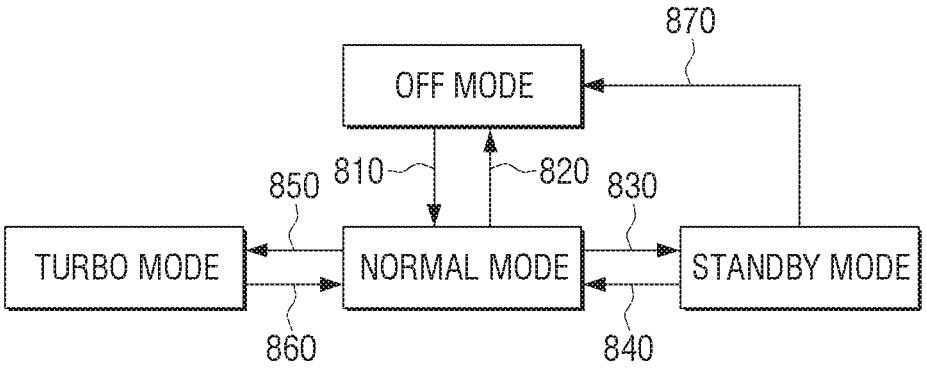
FIGS. 8, 9, and 10 are views provided to explain a mode change relation of a vacuum cleaner according to various embodiments of the disclosure.

FIG. 8 is a view provided to explain a mode change relation of the vacuum cleaner 100, 100', and 400 according to an embodiment of the disclosure.

Referring to FIG. 8, the operation of the vacuum cleaner 100, 100' and 400 according to the operation of the first switch 120 may be the same as an example shown in FIG. 3A. In other words, when the first switch 120 is pressed in a power-off state (an off mode), the vacuum cleaner 100, 100', and 400 may be turned on and operate in a normal mode at operation S810, and when the first switch 120 is pressed in a power-on state, the vacuum cleaner 100, 100', and 400 may be in a power off state at operation S820. FIG. 8 only illustrates an example that a mode of the vacuum cleaner 100, 100', and 400 is changed from a normal mode to an off mode, but when the first switch 120 is pressed in a standby mode or in a turbo mode, the vacuum cleaner 100, 100' and 400 may be in a power off state (an off mode).

Referring to FIG. 8, the vacuum cleaner 100, 100', and 400 may perform an operation according to the operation of the second switch 130 differently from an example shown in FIG. 3A. Referring to FIG. 8, when the second switch 130 is pressed for a predetermined time t1 or more in a normal mode, the vacuum cleaner 100, 100', and 400 may operate in a standby mode at operation S830, and when the second switch 130 is pressed for a predetermined time t1 or more in a standby mode, the vacuum cleaner 100, 100', and 400 may operate in a normal mode at operation S840.

Referring to FIG. 8, the vacuum cleaner 100, 100', and 400 may toggle between a normal mode and a standby mode each time when the second switch 130 is pressed for a predetermined time t1 or more while a power is turned on. The vacuum cleaner 100, 100', and 400 may be embodied so that a mode is changed at a time when the predetermine time t1 arrives after the second switch 130 is pressed. According to an embodiment, the vacuum cleaner 100, 100', and 400 may be embodied so that a mode is change at a time when the pressing of the second switch 130 is released after the second switch 130 is pressed for the predetermined time t1 or more.

The vacuum cleaner 100, 100', and 400 may be in a power-off state (an off mode) when a predetermined time t2 passes without any operation after entering a standby mode at operation S870.

When the second switch 130 is pressed for the predetermined time t1 or less in a normal mode, the vacuum cleaner 100, 100', and 400 may operate in a turbo mode at operation S850, and when the second switch 130 is pressed for the predetermined time t1 or less in a turbo mode, the vacuum cleaner 100, 100', and 400 may operate in a normal mode at operation S860.

Referring to FIG. 8, the vacuum cleaner 100, 100', and 400 may toggle between a normal mode and a turbo mode each time when the second switch 130 is pressed for the predetermined time t1 or less. A mode of the vacuum cleaner 100, 100', and 400 may be changed when after the second switch 130 is pressed, the pressing of the second switch 130 is released before the predetermined time t1 arrives.

FIG. 9 is a view illustrating a mode change relation of the vacuum cleaner 100, 100', and 400 according to an embodiment of the disclosure.

Referring to FIG. 9, the vacuum cleaner 100, 100,' and 400 may be turned on and operate in a standby mode when the first switch 120 is pressed in a power-off state (an off mode) at operation S910, and when the first switch 120 is pressed in a power-on state, the vacuum cleaner 100, 100', and 400 may be in a power-off state at operation S920. The vacuum cleaner 100, 100', and 400 may toggle between a power-off state (an off mode) and a standby mode each time when the first switch 120 is operated. FIG. 9 shows that a mode of the vacuum cleaner 100, 100', and 400 is changed from a standby mode to an off mode according to the operation of the first switch 120, but according to an embodiment, when the first switch 120 is pressed in a normal mode or in a turbo mode, the vacuum cleaner 100, 100', and 400 may be in a power-off state (an off mode).

Since power is not supplied to the motor 110 in a standby mode, unlike the examples of FIGS. 3A and 8, FIG. 9 shows that the motor 110 is not driven although the power of the vacuum cleaner 100, 100', and 400 is turned on according to the operation of the first switch 120. Therefore, it could be difficult for a user to recognize whether the vacuum cleaner 100, 100,' and 400 is in a standby mode or in a power-off state (an off mode), the power of the vacuum cleaner 100, 100', and 400 may be turned on according to the operation of the first switch 120, and when the vacuum cleaner 100, 100', and 400 operates in a standby mode, the vacuum cleaner 100, 100', and 400 may display a UI indicating that the vacuum cleaner 100, 100', and 400 operates in a standby mode. As described above, the vacuum cleaner 100, 100', and 400 may display a UI indicating a present operation mode, and this embodiment may have a greater significance in the example of FIG. 9.

When the second switch 130 is pressed for the predetermined time t1 or mode in a standby mode, the vacuum cleaner 100, 100', and 400 may operate in a turbo mode at operation S930, and when the second switch 130 is pressed for the predetermined time t1 or more in a turbo mode, the vacuum cleaner 100, 100', and 400 may operate in a standby mode. As shown in FIG. 9, the vacuum cleaner 100, 100', and 400 may toggle between a turbo mode and a standby mode each time when the second switch 130 is pressed for the predetermined time t1 or more while the power is turned on.

The vacuum cleaner 100, 100', and 400 may be configured so that a mode could be changed when the predetermined time t1 arrives after the second switch 130 is pressed. The vacuum cleaner 100, 100', and 400 may be configured so that a mode could be changed at a time when the pressing of the second switch 130 is released after the second switch 130 is pressed for the predetermined time t1 or more.

A mode of the vacuum cleaner 100, 100', and 400 may be changed from a standby mode to a normal mode when the second switch 130 is for the predetermined time t1 or less at operation S950, and when the second switch 130 is pressed for the predetermined time t1 or less in a normal mode, a mode of the vacuum cleaner 100, 100', and 400 may be changed to a standby mode at operation S960. As shown in FIG. 9, the vacuum cleaner 100, 100', and 400 may toggle between a normal mode and a standby mode each time when the second switch 130 is pressed for the predetermined time t1 or less while the power is turned on. A mode of the vacuum cleaner 100, 100', and 400 may be changed at a time when the pressing of the second switch 130 is released before the predetermined time t1 arrives after the second switch 130 is pressed.

In the same manner as other embodiments, the vacuum cleaner 100, 100', and 400 of FIG. 9 may be in a power-off state (an off mode) after a predetermined time t2 passes without any operation in a standby mode at operation S970.

Although not shown, according to an embodiment, as shown in FIG. 9, a direction mode change may occur between a normal mode and a turbo mode. For example, when the second switch 130 is pressed for the predetermined time t1 or more in a normal mode, the vacuum cleaner 100, 100', and 400 may operate in a turbo mode. The vacuum cleaner 100, 100', and 400 may operate in a turbo mode at a time when the predetermined time t1 arrives after the second switch 130 is pressed, or at a time when the pressing of the second switch 130 is released after the second switch 130 is pressed for the predetermined time t1 or more.

The vacuum cleaner 100, 100', and 400 may operate in a normal mode when the second switch is pressed for the predetermined time t1 or less while the vacuum cleaner 100, 100', and 400 operates in a turbo mode. The vacuum cleaner 100, 100' and 400 may operate in a normal mode at a time when the pressing of the second switch 130 is released before the predetermined time t1 arrives after the second switch 130 is pressed during the operation in a turbo mode.

FIG. 10 is a view illustrating a mode change relation of the vacuum cleaner 100, 100', and 400 according to an embodiment of the disclosure.

Referring to FIG. 10, when the first switch 120 is pressed in a power off state (or an off mode), the vacuum cleaner 100, 100', and 400 may be turned on and operate in a standby mode at operation S1010, and when the first switch 120 is pressed in a power-on state, the vacuum cleaner 100, 100', and 400 may be in a power-off state at operation S1020. The vacuum cleaner 100, 100' and 400 may toggle between a power-off state (off mode) and a standby mode each time when the first switch 120 is operated. FIG. 10 illustrates an example where the vacuum cleaner 100, 100', and 400 is changed from a standby mode to an off mode according to the operation of the first switch 120, but the vacuum cleaner 100, 100', and 400 may be in a power-off state (an off mode) when the first switch 120 is pressed in a normal mode and in a turbo mode.

When the second switch 130 is pressed for the predetermined time t1 or less in a standby mode, the vacuum cleaner 100, 100', and 400 may be changed to a normal mode at operation S1030, and when the second switch 130 is pressed for the predetermined time t1 or less in a normal mode, the vacuum cleaner 100, 100', and 400 may be changed to a standby mode at operation S1040. A mode of the vacuum cleaner 100, 100', and 400 may be changed at a time when the pressing of the second switch 130 is released before the predetermined time t1 arrives after the second switch 130 is pressed, but the disclosure is not limited thereto.

The vacuum cleaner 100, 100', and 400 may operate in a turbo mode when the second switch 130 is pressed for the predetermined time t1 or more in a normal mode at operation S1050, and when the second switch 130 is pressed for the predetermined time t1 or more in a turbo mode, the vacuum cleaner 100, 100', and 400 may operate in a normal mode again at operation S1060. The vacuum cleaner 100, 100', and 400 may be embodied so that a mode may be changed at a time when the predetermined time t1 arrives after the second switch 130 is pressed, or embodied so that a mode may be changed at a time when the pressing of the second switch 130 is released after the second switch 130 is pressed for the predetermined time t1 or more.

In the same manner as other various embodiments, the vacuum cleaner 100, 100', and 400 of FIG. 10 may be in a power-off mode (an off mode) when a predetermined time t2 passes without operation in a standby mode at operation S1070. The vacuum cleaner 100, 100', and 400 may display a UI indicating a present operation mode when a power is turned on. In the description of FIGS. 8 to 10, the vacuum cleaner 100, 100', and 400 is exemplified as the subject of operation for convenience of explanation, but as described above, to be specific, the first processor 141 may control a power on/off state of the vacuum cleaner 100, 100', and 400 by controlling the third switch 145 by detecting a user operation with respect to the first switch 120, and control a mode change by detecting a user operation with respect to the second switch 130 while the second processor 150 is turned on. In addition, it is exemplified that a time duration for which the second switch 130 is pressed when a power is turned on is used as an event that triggers a mode change. However, the disclosure is not limited thereto. A mode change may be triggered by using another event such as the number of pressing the second switch 130 when the power of the vacuum cleaner 100, 100', and 400 is turned on.

For example, an event where the second switch 130 is pressed twice within a predetermined third time t3 may be used as an event where the vacuum cleaner 100, 100', and 400 toggles between a normal mode and a turbo mode, and an event where the second switch 130 is pressed once may be used as an event where vacuum cleaner 100, 100', and 400 toggles between a normal mode and a standby mode.

For example, referring to FIG. 3A, when the vacuum cleaner 100, 100', and 400 operates in a normal mode, when the second switch 130 is pressed once and the second switch 130 is pressed again within a predetermined third time t3, the vacuum cleaner 100, 100', and 400 may operate in a turbo mode. In addition, during the operation in a turbo mode, when the second switch 130 is pressed once and the second switch 130 is pressed again within the predetermined third time t3, the vacuum cleaner 100, 100', and 400 may operate in a normal mode.

While the vacuum cleaner 100, 100', and 400 operates in a normal mode, when the second switch 130 is not pressed again after the second switch 130 is pressed once, and the predetermined third time t3 passes from a time when the second switch 130 is pressed once, the vacuum cleaner 100, 100', and 400 may operate in a standby mode at a time when the predetermined third time t3 passes. During the operation in a standby mode, when the second switch 130 is not pressed again after the second switch 130 is pressed once, and the predetermined third time t3 passes after a time when the second switch 130 is pressed once, the vacuum cleaner 100, 100', and 400 may operate in a normal mode at a time when the predetermined third time t3 passes.

According to another embodiment, when the vacuum cleaner 100, 100', and 400 is turned on, a mode may be changed each time when the second switch 130 is pressed. For example, referring to FIG. 10, when the vacuum cleaner 100, 100', and 400 is turned on according to the operation of the first switch 120 and operates in a standby mode, each time when the second switch 130 is pressed, a mode may be changed from a normal mode 1030 to a turbo mode 1050 to a normal mode 1060 and a standby mode 1040.

According to various embodiments of the disclosure, a user may operate all operation modes of a vacuum cleaner with one switch during the use of the vacuum cleaner, and accordingly, operational convenience of a vacuum cleaner for a user may be enhanced.

The operations of the processors 141 and 150 of the vacuum cleaner 100, 100' and 400 and controlling methods for the vacuum cleaner 100, 100', and 400 according to various embodiments of the disclosure may be performed by software and mounted on the vacuum cleaner 100, 100', and 400.

For example, when the power of the vacuum cleaner 100, 100', and 400 is turned on according to the operation of the first switch 120, a non-transitory computer readable medium may be stalled, in which a program for performing a controlling method for the vacuum cleaner 100, 100', and 400 including operating in a normal mode where the motor 110 is rotated at a speed of RPM and operating in a standby mode where power supplied to the motor 110 is turned off according to the operation of the second switch 130 in a normal mode is stored.

According to an embodiment of the disclosure, a process may be stored in a non-transitory readable medium in the form of a program, which is not a medium for storing data for a short period of time such as register, cache, memory, etc., but a medium for semi-permanently data. This means that the non-transitory readable medium is a medium read by a device. The various applications or programs described above may be stored on the non-transitory computer readable medium such as a compact disk (CD), a digital versatile disc (DVD), a hard disk, a blu-ray disk, a universal serial bus (USB), a memory card, a read only memory (ROM), or the like.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A vacuum cleaner, comprising:

a motor configured to rotate at a predetermined number of revolutions per minute (RPM) in a normal mode;

a first switch configured to control a power on/off operation of the vacuum cleaner;

a second switch configured to change an operation mode of the vacuum cleaner;

a battery unit including a first processor configured to, based on the first switch being pressed, control a power of the vacuum cleaner to be turned on; and a second processor configured to:

based on the power of the vacuum cleaner being turned on according to an operation of the first switch, control the vacuum cleaner to operate in the normal mode, and according to an operation of the second switch in the normal mode, control the vacuum cleaner to operate in a standby mode where power supplied to the motor is turned off.

2. The vacuum cleaner as claimed in claim 1, wherein the battery unit comprises:

a battery pack configured to supply power to the vacuum cleaner; and a third switch configured to connect the battery pack to the vacuum cleaner, wherein the first processor is further configured to, each time when the first switch is pressed, control the vacuum cleaner to toggle between a power-on state and a power-off state by controlling an on/off state of the third switch.

3. The vacuum cleaner as claimed in claim 1, wherein the second processor is further configured to control the vacuum cleaner to operate in the standby mode or in a turbo mode where the motor is rotated at a number of RPM higher than the predetermined RPM according to a time duration for which the second switch is pressed in the normal mode.

4. The vacuum cleaner as claimed in claim 3, wherein the second processor is further configured to, based on the second switch being pressed for a predetermined time or more in the normal mode, control the vacuum cleaner to operate in the turbo mode from a time when the second switch is pressed and the predetermined time passes until a time when a pressing of the second switch is released.

5. The vacuum cleaner as claimed in claim 4, wherein the second processor is further configured to, based on the pressing of the second switch being released after the vacuum cleaner operates in the turbo mode, control the vacuum cleaner to operate in the normal mode.

6. The vacuum cleaner as claimed in claim 1, wherein the second processor is further configured to, based on the pressing of the second switch being released within a predetermined time after the second switch is pressed in the normal mode, control the vacuum cleaner to operate in the standby mode.

7. The vacuum cleaner as claimed in claim 6, wherein the second processor is further configured to, based on the second switch being pressed in the standby mode, control the vacuum cleaner to operate in the normal mode.

8. The vacuum cleaner as claimed in claim 1, wherein the second processor is further configured to turn off the power of the vacuum cleaner when a predetermined time passes without mode change from the standby mode to another mode.

9. The vacuum cleaner as claimed in claim 1, further comprising:

a display, wherein the second processor is further configured to control the display to display a user interface (UI) indicating a present operation mode of the vacuum cleaner.

10. The vacuum cleaner as claimed in claim 2, wherein the first and second switches are physical switches which are turned on when pressed, and turned off when depressed, and wherein the third switch is a semiconductor switch which is turned on or off under a control of the first processor.

11. A method for controlling a vacuum cleaner including a motor, a first switch for controlling a power on/off operation, and a second switch for changing an operation mode, the method comprising:

operating in a normal mode in which the motor is rotated at a predetermined revolutions per minute (RPM) based on power of the vacuum cleaner being turned on based on an operation of the first switch;

operating in a standby mode in which power supplied to the motor is turned off based on an operation of the second switch in the normal mode; and operating in the standby mode or in a turbo mode where the motor is rotated at a number of RPM higher than the predetermined RPM, based on a time duration for which the second switch is pressed in the normal mode.

12. The method as claimed in claim 11, wherein the vacuum cleaner is configured to toggle between a power-on state and a power-off state at each occurrence when the first switch is pressed, and wherein the operating in the normal mode comprises, based on the first switch being pressed and the vacuum cleaner being in the power-on state, operating in the normal mode.

13. The method as claimed in claim 11, further comprising:

based on the second switch being pressed for a predetermined time or more in the normal mode, operating in the turbo mode from a time when the second switch is pressed and the predetermined time passes until a time when a pressing of the second switch is released.

14. The method as claimed in claim 13, further comprising:

based on the pressing of the second switch being released during an operation in the turbo mode, operating in the normal mode.

15. The method as claimed in claim 11, wherein the operating in the standby mode comprises, based on a pressing of the second switch being released within a predetermined time after the second switch is pressed in the normal mode, operating in the standby mode.

16. The method as claimed in claim 15, further comprising:

based on the second switch being pressed in the standby mode, operating in the normal mode.

17. The method as claimed in claim 11, further comprising:

based on a predetermined time passing without a mode change from the standby mode to another mode, turning off the power of the vacuum cleaner.

18. The method as claimed in claim 11, further comprising:

displaying a user interface (UI) indicating a present operation mode of the vacuum cleaner.

19. The method as claimed in claim 12, wherein the first switch and the second switch are physical switches which are turned on when pressed, and turned off when decompressed, and wherein the vacuum cleaner further includes a third switch comprising a semiconductor switch which is turned on or off under a control of a first processor.

* * * * *